US006659806B2

(12) United States Patent
Shi et al.

(10) Patent No.: US 6,659,806 B2
(45) Date of Patent: Dec. 9, 2003

(54) MODULAR JACK CONNECTOR

(75) Inventors: GuangXing Shi, Kunsan (CH); Qiang Chen, Kunsan (CH)

(73) Assignee: Hon Hai Precision Ind.? Co., Ltd., Taipei Hsien (TW)

( * ) Notice: Subject to any disclaimer, the term of this patent is extended or adjusted under 35 U.S.C. 154(b) by 0 days.

(21) Appl. No.: 10/175,991

(22) Filed: Jun. 19, 2002

(65) Prior Publication Data

US 2003/0119371 A1 Jun. 26, 2003

(30) Foreign Application Priority Data

Dec. 26, 2001 (TW) ..... 90222978 U

(51) Int. Cl.[7] ..... H01K 24/00
(52) U.S. Cl. ..... 439/676
(58) Field of Search ..... 439/676, 607, 439/344

(56) References Cited

U.S. PATENT DOCUMENTS 6,196,879 B1 * 3/2001 Hess et al. ..... 439/676
6,210,237 B1 * 4/2001 Chang ..... 439/676
6,257,935 B1 * 7/2001 Zhang et al. ..... 439/676
6,402,562 B1 * 6/2002 Chang et al. ..... 439/676

* cited by examiner

*Primary Examiner*—Gary Paumen
(74) *Attorney, Agent, or Firm*—Wei Te Chung

(57) ABSTRACT

A modular jack connector (1) comprises an insulating housing (10) and a row of terminals (22) retained in the housing. The housing has a mounting face (10*e*) adapted for mounting onto a circuit board, and a mating face (10*a*) and two opposite side faces (10*b*, 10*c*) all substantially perpendicular to the mounting face. The mating face defines a cavity (11) for receiving a complementary connector (4) therein. One of the side faces defines a channel (12) communicating with the cavity for receiving therein a latch arm (40) of the complementary connector. Each terminal includes a mating portion (220) extending into the cavity and a tail portion (224) projecting beyond the mounting face of the housing for electrically connecting to the circuit board. The mating portions of the row of the terminals are arranged in a direction generally perpendicular to the mounting face of the housing.

1 Claim, 7 Drawing Sheets

MODULAR JACK CONNECTOR

BACKGROUND OF THE INVENTION

1. Field of the Invention

The present invention relates to a modular jack connector, and particularly to a modular jack connector which is so configured and mounted in a notebook computer that it can facilitate a connection/disconnection of a complementary plug connector therewith/therefrom.

2. Description of the Related Art

Modular jacks, especially known as RJ45 and RJ11 connectors, are frequently used in notebook computers for internet and intranet connection. Referring to FIGS. 6 and 7, FIG. 6 shows a conventional RJ45 receptacle connector 5 comprising an insulating housing 6, a terminal insert 7 for being retained in the housing 6 and a shield 8 for being assembled onto the housing 6. The housing 6 has a mounting face 6*c* for mounting onto a circuit board (not shown) of a notebook computer 100, a mating face 6*a* substantially perpendicular to the mounting face 6*c*, and a top face 6*b* opposite to the mounting face 6*c*. The mating face 6*a* defines a cavity 60 for receiving a complementary RJ45 plug connector 9 therein. The top face 6*b* defines a channel 62 communicating with the cavity 60 for engageably receiving therein a latch arm 90 of the plug connector 9. The mounting face 6*c* defines an opening 64 communicating with the cavity 60. The terminal insert 7 includes an insulating portion 70 for being retained in the opening 64 of the housing 6, and a plurality of terminals 72 secured to the insulating portion 70. Each terminal 72 includes a mating portion 720 received in the cavity 60 of the housing 6, and a tail portion 724 projecting downwardly beyond the mounting face 6*c* of the housing 6 for electrically connecting to the circuit board of the notebook computer 100.

FIG. 7 schematically shows a relationship between the RJ45 receptacle connector 5 mounted in the notebook computer 100 and the complementary RJ45 plug connector 9. The cavity 60 and the channel 62 of the receptacle connector 5 are exposed outside through a side panel 100*a* of the notebook computer 100. It can be seen that the channel 62 of the receptacle connector 5 is located adjacent to a top panel 100*b* of the notebook computer 100.

When the RJ45 plug connector 9 is inserted into the cavity 60 of the RJ45 receptacle connector 5 by a user, the latch arm 90 of the plug connector 9 is partially received in the channel 62 to thereby securely lock the plug connector 9 in the receptacle connector 5. When the plug connector 9 is required to be disengaged from the receptacle connector 5, the user thumbs down the latch arm 90 and pulls the plug connector 9 away from the receptacle connector 5. It can be understood that the thickness of the notebook computer 100 must be sufficiently large whereby there is enough space below the plug connector 9 to accommodate finger(s) of the user so that the finger(s) can grip a bottom face of the plug connector 9 to exert the pulling force.

However, with a miniaturization development of the notebook computers, the thickness of the notebook computer becomes thinner and thinner. Correspondingly, the space available for operating the plug connector 9 becomes limited, which results in an inconvenience for inserting or disengaging the plug connector 9 into or from the receptacle connector 5. Thus, the arrangement of the prior art regarding the receptacle connector 5 and the notebook computer 100 generates difficulty in fulfilling the miniaturization development of the notebook computers.

Hence, the present invention aims to provide an improved modular jack receptacle connector mounted in a notebook computer to overcome the disadvantages of the prior art.

SUMMARY OF THE INVENTION

Accordingly, an object of the present invention is to provide an improved modular jack connector mounted in a notebook computer wherein the connector is so configured that it can facilitate a connection/disconnection of a complementary plug connector therewith/therefrom.

To achieve the above-mentioned object, a modular jack connector in accordance with the present invention comprises an insulating housing and a row of terminals retained in the housing. The housing has a mounting face adapted for mounting onto a circuit board, and a mating face and two opposite side faces all substantially perpendicular to the mounting face. The mating face defines a cavity for receiving therein a complementary connector. One of the side faces defines a channel communicating with the cavity for receiving therein a latch arm of the complementary connector. Each terminal includes a mating portion extending into the cavity and a tail portion projecting beyond the mounting face of the housing for electrically connecting to the circuit board. Comparing with the conventional modular jack connectors, the tail portions of the connector of this invention are twisted 90 degrees such that the mating portions of the row of the terminals are arranged in a direction generally perpendicular to the mounting face of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
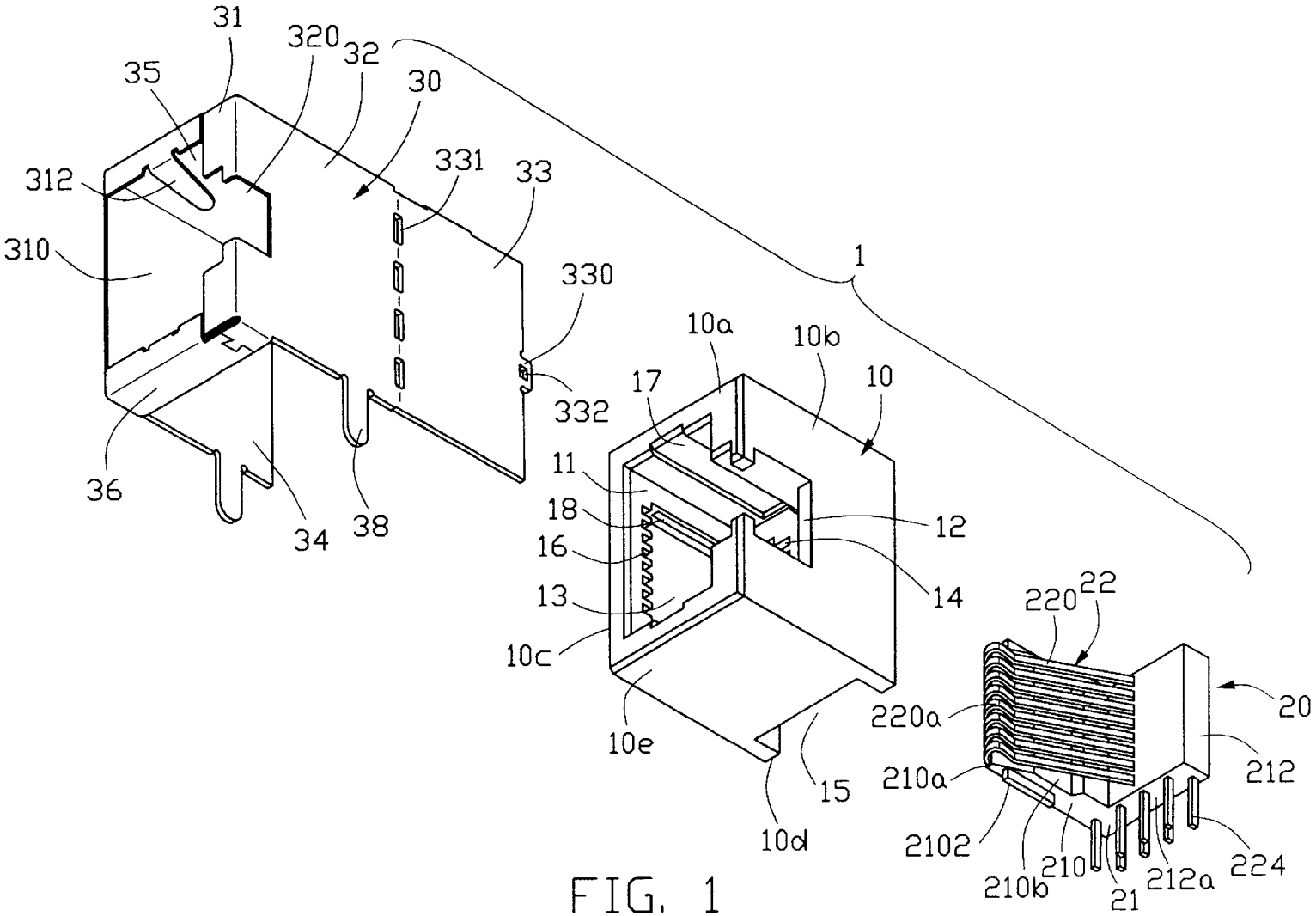
FIG. 1 is an exploded perspective view of a modular jack receptacle connector in accordance with the present invention.

Referring to FIG. 1, an RJ45 receptacle connector 1 mounted in a notebook computer 2 (FIG. 5) in accordance with the present invention comprises an insulating housing 10, a terminal insert 20 for being retained in the housing 10, and a shield 30 for being assembled onto the housing 10 for Electromagnetic Interference (EMI) protection.

The insulating housing 10 has a mounting face 10*e* adapted for mounting onto a circuit board (not shown) of the notebook computer 2, a mating face 10*a* perpendicular to the mounting face 10*e*, and two opposite side faces 10*b*, 10*c* also perpendicular to the mounting face 10*e*. The mating face 10*a* defines a cavity 11 for receiving a complementary RJ45 plug connector 4 (FIG. 5) therein. The side face 10*b* defines a channel 12 communicating with the cavity 11 for receiving therein a latch arm 40 of the plug connector 4. The housing 10 defines an opening 13 in the side face 10*c* communicating with the cavity 11 and a cutout 15 in a rear face 10*d* thereof. A plurality of passageways 14 is defined in the housing 10 communicating with the cavity 11 and the cutout 15. In addition, the housing 10 defines a plurality of slots 16 in front of the opening 13 and communicating with the cavity 11, a pair of grooves 18 respectively above and below the opening 13, and a pair of recesses 17 respectively above and below the cavity 11.

The terminal insert 20 includes an insulating body 21 and a plurality of terminals 22 secured to the insulating body 21. In the preferred embodiment of the present invention, the terminals 22 have a quantity of eight. The insulating body 21 includes a first and a second portions 210, 212 generally perpendicular to each other. The first portion 210 is formed with a pair of guiding portions 2102 on opposite upper and lower sides thereof for guiding and securing the terminal insert 20 into the housing 10.

Figure 2:
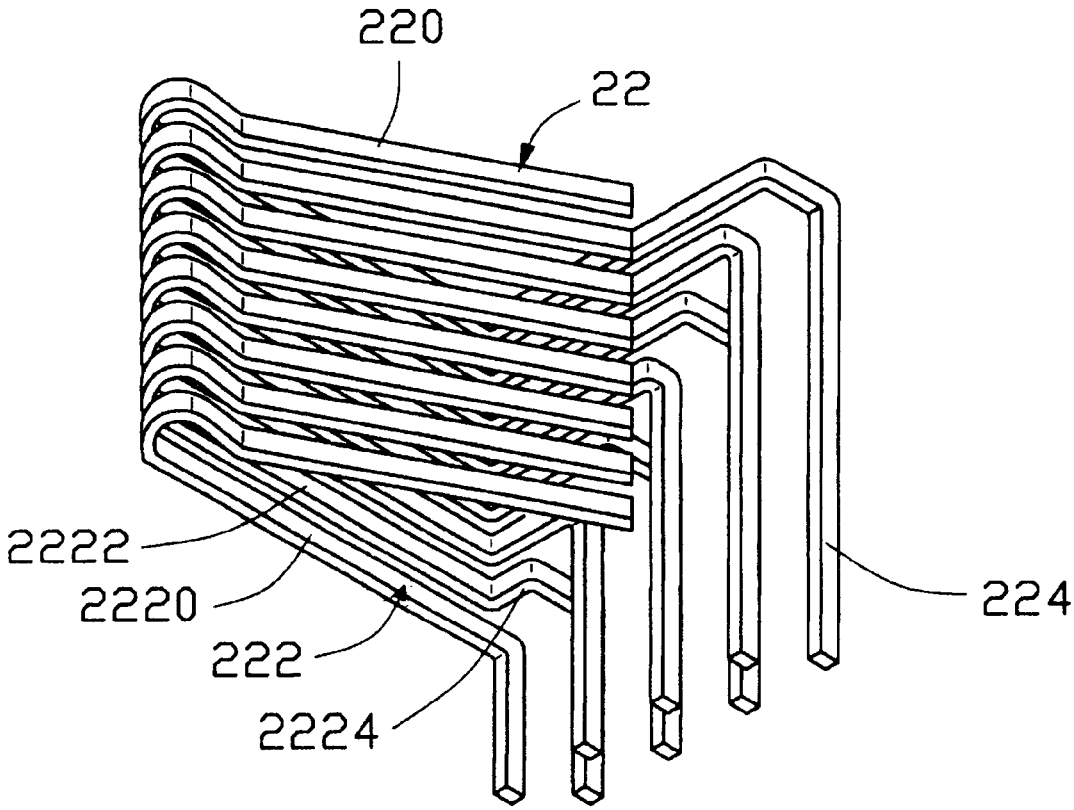
FIG. 2 is a perspective view of terminals of the receptacle connector of FIG. 1.

Referring to FIG. 2 in conjunction with FIG. 1, each terminal 22 includes a middle retention portion 222 embedded in the insulating body 21, a mating portion 220 extending from a front end of the retention portion 222 and being angled rearwardly from a front nose 210*a* of the insulating body 21 to be disposed beside a face 210*b* of the first portion 210, and a tail portion 224 extending from a rear end of the retention portion 222 and projecting beyond a bottom face 212*a* of the second portion 212 of the insulating body 21 in two rows in a staggered manner. Obviously, each terminal 22 has a curved portion 220*a* at the front nose 210*a* of the insulating body 21. The retention portions 222 have first sections 2220, 2222 disposed in a common vertical plane. The first section 2220 of a lowest terminal 22 and the first sections 2222 of other seven terminals 22 are all embedded in the first portion 210 of the insulating body 21. Furthermore, the other seven terminals 22 have second sections 2224 generally perpendicular to the first sections 2222 and embedded in the second portion 212 of the insulating body 21. The second sections 2224 have different lengths to thereby make the tail portions 224 of the terminals 22 spaced varied distances from the common vertical plane of the first sections 2220, 2222.

The shield 30 is stamped from a single metal sheet and comprises a front wall 31 defining an aperture 310 in correspondence with the cavity 11 of the housing 10, a first side wall 32 perpendicularly extending from a side edge of the front wall 31, a rear wall 33 rearwardly extending from a rear edge of the first side wall 32, a second side wall 34 opposite to the first side wall 32, and a top wall 35 connecting with the first and the second walls 32, 34 and a flap 36 opposite to the top wall 35. A perforation 331 is defined between the first side wall 32 and the rear wall 33 to facilitate a bending of the rear wall 33 to cover the rear face 10*d* of the housing 10. The first side wall 32 defines a cutout 320 corresponding to the channel 12 of the housing 10. The rear wall 33 has a projection 330 with a hole 332 defined therein at a rear end thereof. The shield 30 is provided with a pair of resilient flanges 312 integrally extending from the front wall 31 and bent rearwardly, and a pair of ground legs 38 respectively extending downwardly from the first and the second side walls 32, 34.

Figure 3:
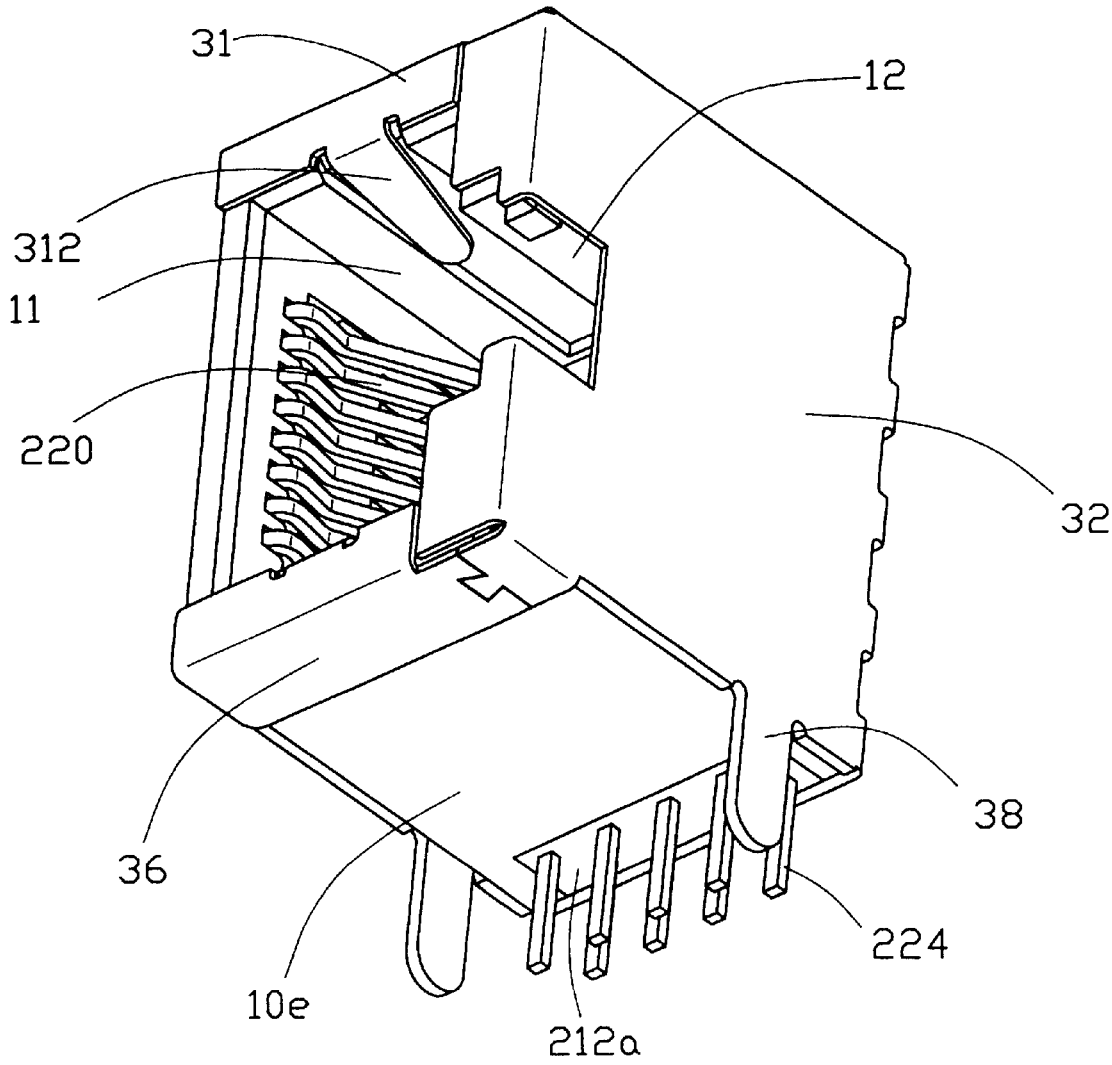
FIG. 3 is an assembled view of the receptacle connector of FIG. 1.
Figure 4:
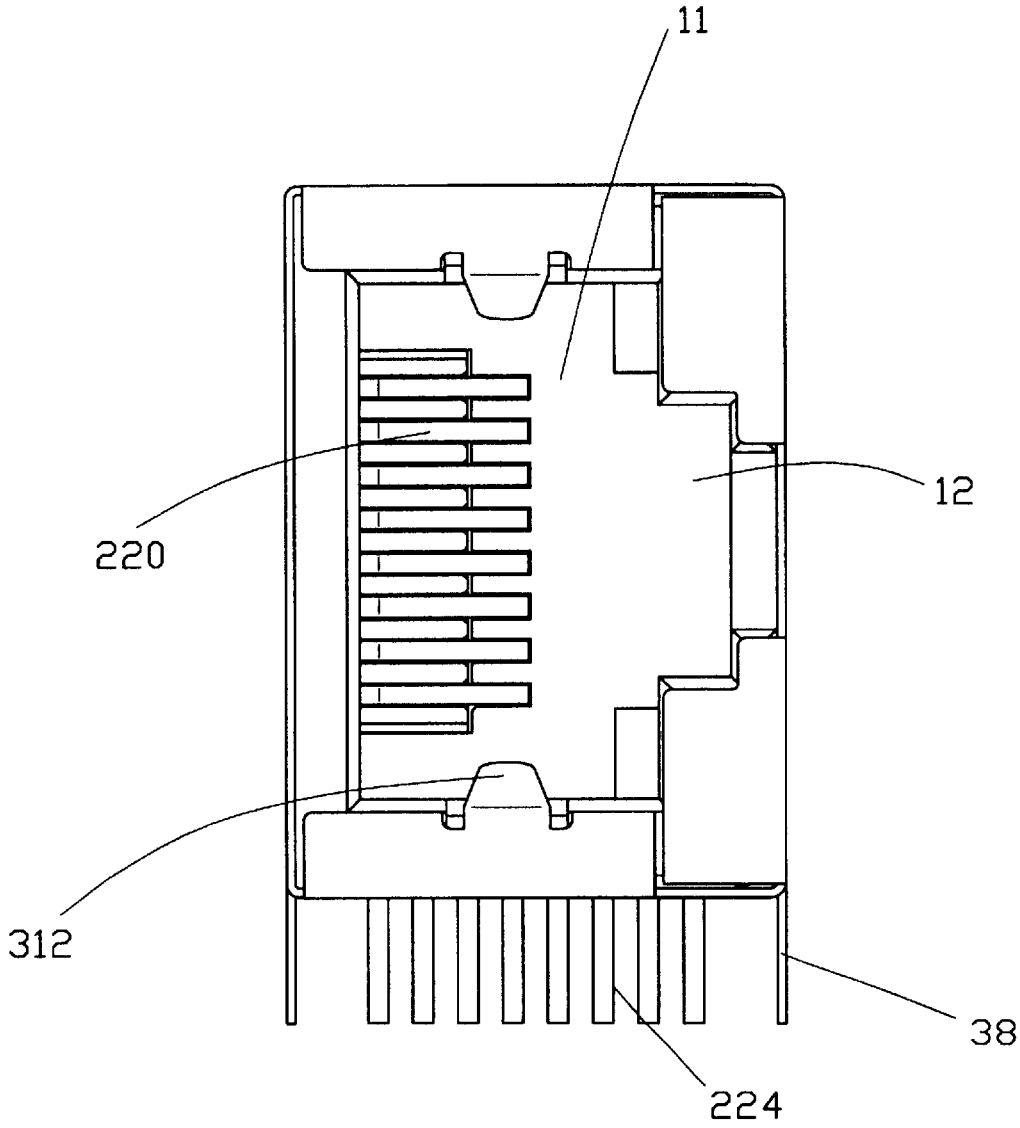
FIG. 4 is a front plan view of the receptacle connector of FIG. 3.

Referring to FIGS. 3 and 4, in assembly, the terminal insert 20 is assembled to the housing 10 from the rear face 10*d* of the housing 10. The guiding portions 2102 of the terminal insert 20 are received in the grooves 18 of the housing 10 for facilitating insertion of the first portion 210 into the opening 13 until the curved portions 220*a* of the terminals 22 are received in the slots 16. The mating portions 220 of the terminals 22 are received in the cavity 11 for engaging with corresponding terminals (not shown) of the RJ45 plug connector 4. At the same time, free ends of the mating portions 220 are received in the passageways 14 of the housing 10. The second portion 212 of the insulating body 21 is received in the cutout 15 of the housing 10, and the tail portions 224 of the terminals 22 project beyond the mounting face 10*e* of the housing 10 for soldering to the circuit board of the notebook computer 2.

Finally, the shield 30 is assembled to the housing 10 from the mating face 10*a* by positioning the front wall 31 on the mating face 10*a* of the housing 10 with the cavity 11 being exposed outside through the aperture 310. The resilient flanges 312 are aligned with the recesses 17 of the housing 10. The rear wall 33 is folded to abut the rear face 10*d* of the housing 10. In addition, the hole 332 of the projection 330 engages with a protrusion (not shown) on the rear face 10*d* of the housing 10, thereby fixedly securing the shield 30 on the housing 10. The resilient flanges 312 are for electrically engaging with a shielding of the plug connector 4, and the legs 38 are for soldering to a grounding circuit of the circuit board.

Figure 5:
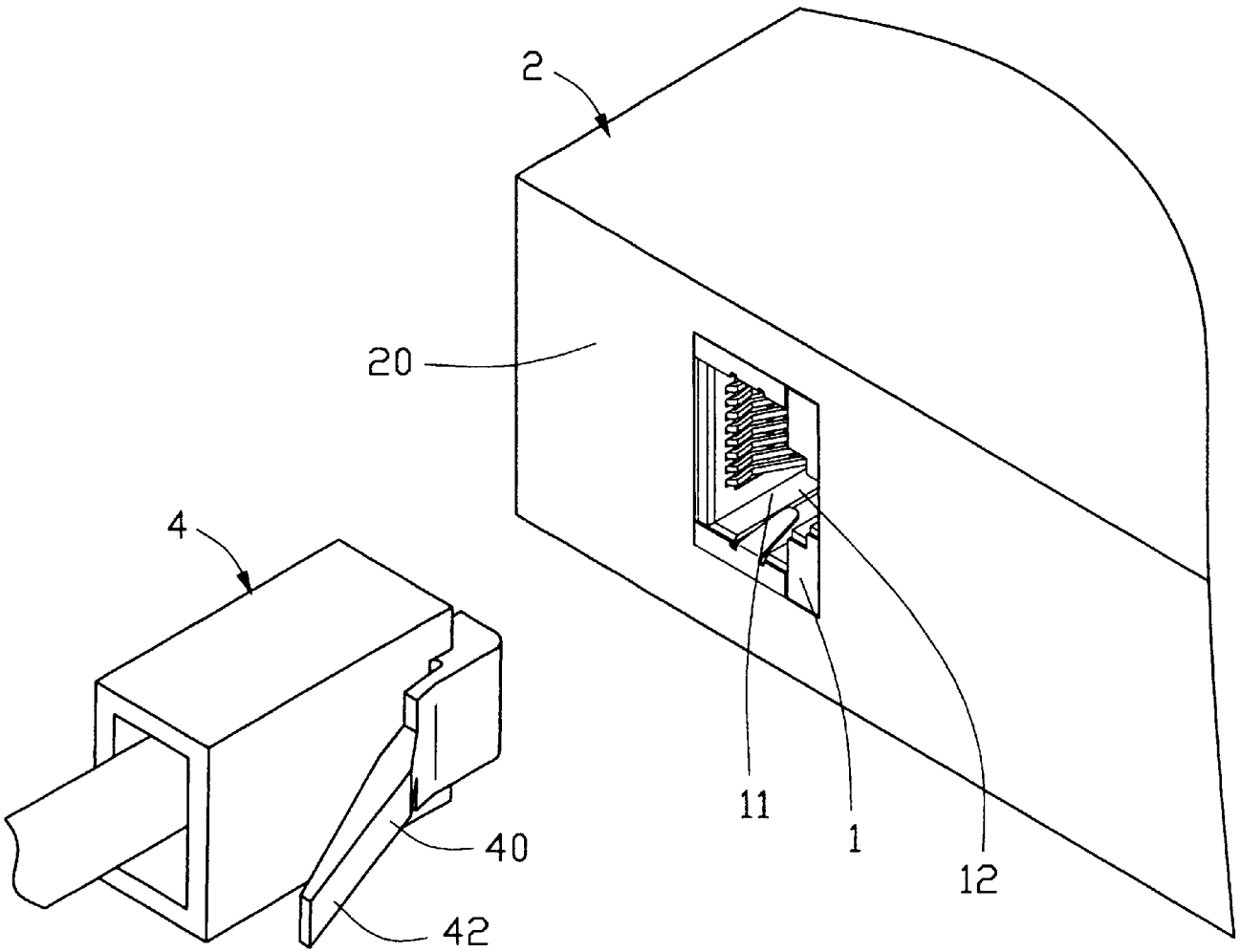
FIG. 5 is a schematic view showing a relationship between the receptacle connector mounted in a notebook computer and a complementary plug connector.
Figure 6:
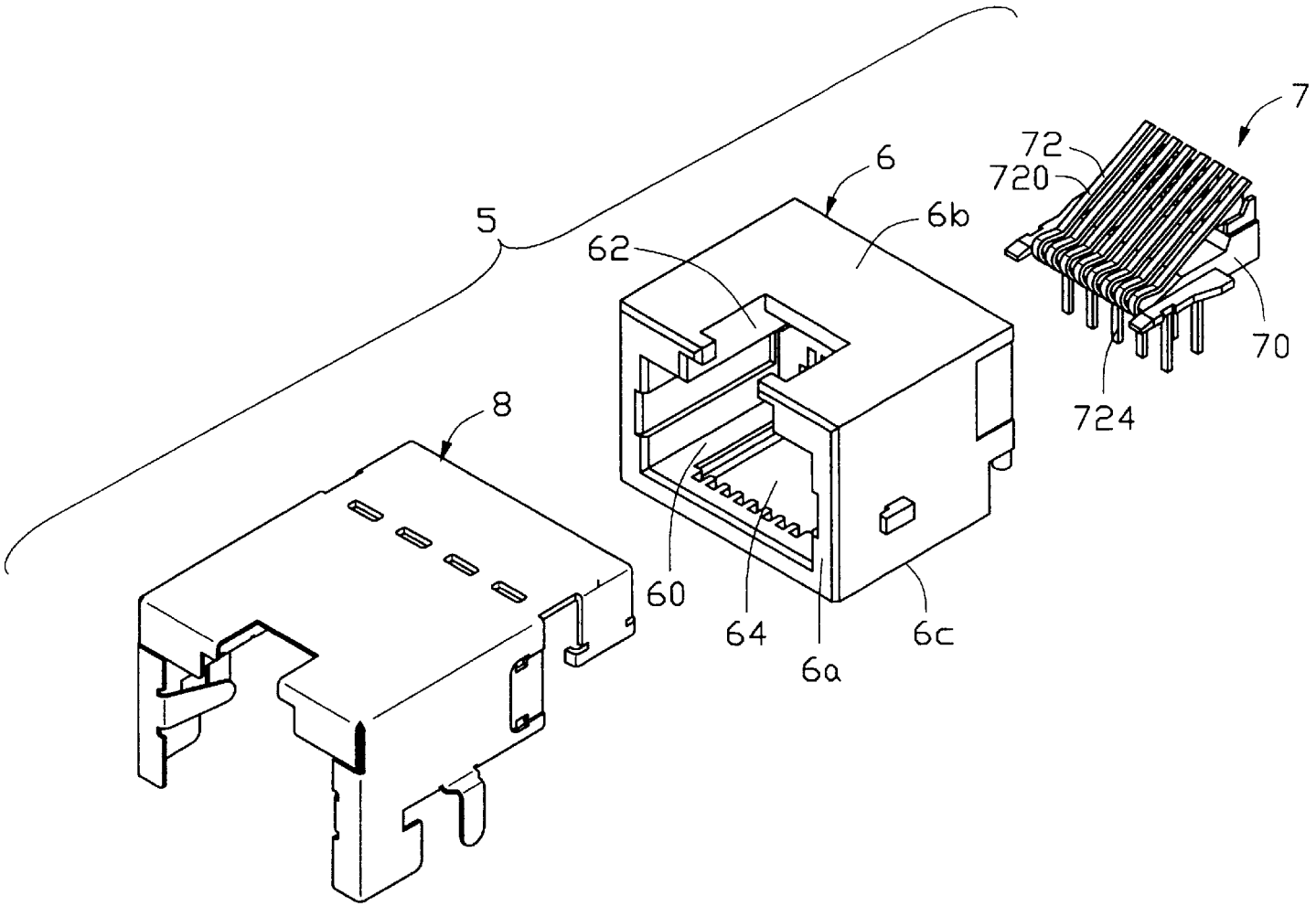
FIG. 6 (PRIOR ART)
FIG. 6 is an exploded perspective view of a conventional modular jack receptacle connector.
Figure 7:
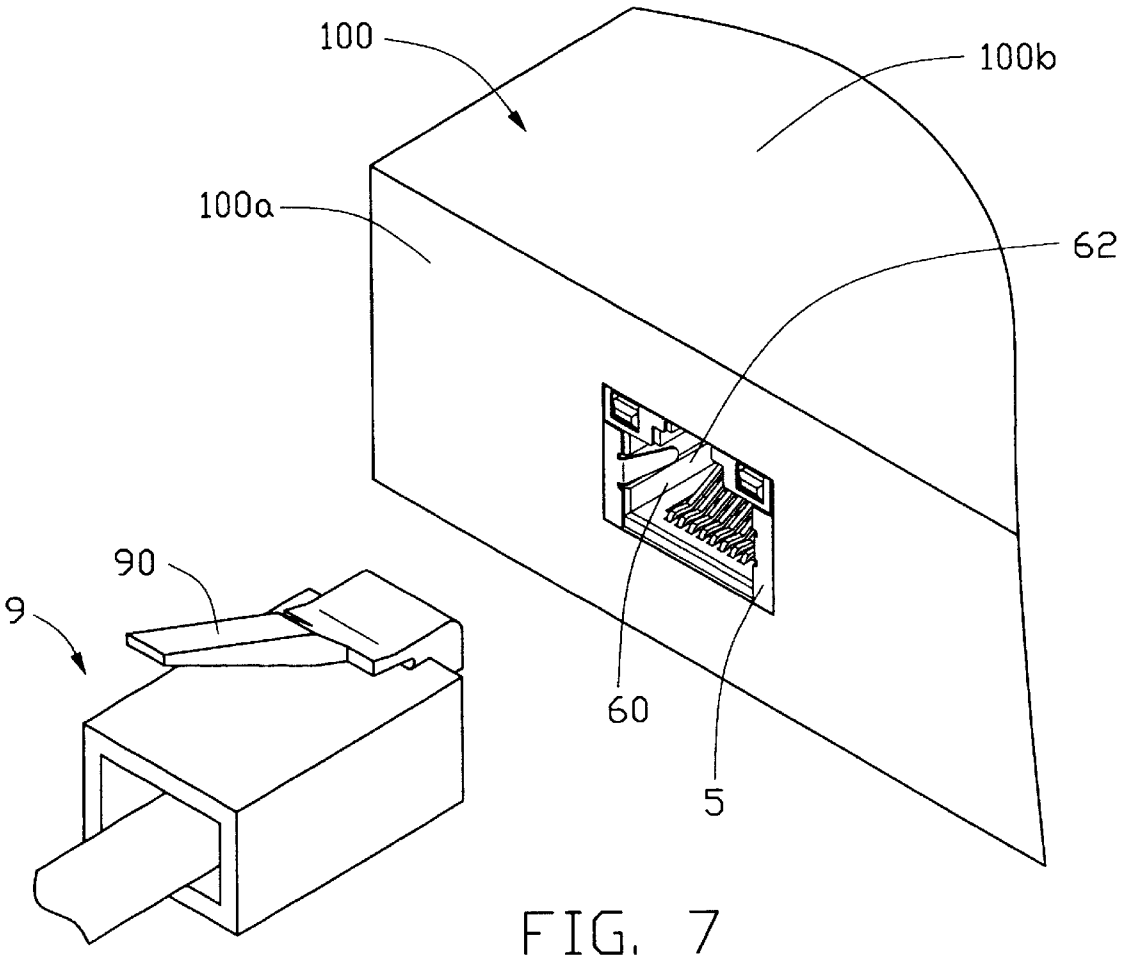
FIG. 7 (PRIOR ART)
FIG. 7 is a schematic view showing a relationship between the receptacle connector of FIG. 6 mounted in a notebook computer and a complementary plug connector.

As schematically shown in FIG. 5, when the RJ45 receptacle connector 1 is mounted on the circuit board of the notebook computer 2, the cavity 11 and the channel 12 are both exposed outside through a panel 20 of the notebook computer 2. The channel 12 is generally positioned at a middle section of the panel 20 along a thickness direction of the notebook computer 2 and at a lateral side of the cavity 11. When the RJ45 plug connector 4 is inserted into the cavity 11 of the RJ45 receptacle connector 1 by a user's fingers, the latch arm 40 is oriented sidewardly and partially received in the channel 12 with a free end 42 thereof being left outside of the notebook computer 2. When the plug connector 4 is required to be disengaged from the receptacle connector 1, the user's thumb and forefinger grasp the plug connector 4 in a direction generally perpendicular to the thickness direction of the notebook computer 2. The RJ45 plug connector 4 can be easily pulled out from the RJ45 receptacle connector 1 as long as the user's thumb or forefinger presses against the free end 42 of the latch arm 40.

Because the latch arm 40 is located at a side portion of the plug connector 4, there is no need to provide additional space in the thickness direction of the notebook computer 2 to accommodate the latch arm 40. More importantly, the user's thumb and forefinger operate the plug connector 4 in the direction generally perpendicular to the thickness direction of the notebook computer 2, whereby the thumb and the forefinger of the user do not occupy the space of the notebook computer in the thickness direction. Therefore, such an arrangement between the RJ45 receptacle connector 1 and the circuit board of the notebook computer 2 not only conforms to the increasing trend of the miniaturization development of the notebook computers but also facilitate insertion/extraction of the RJ45 plug connector 4 in a limited space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack connector for mating with a complementary connector, comprising:

an insulating housing having a mounting face adapted for mounting onto a circuit board; and a mating face and two opposite side faces all substantially perpendicular to the mounting face, the mating face defining a cavity for receiving the complementary connector therein, one of the side faces defining a channel communicating with the cavity for receiving therein a latch arm of the complementary connector; and a row of terminals retained in the housing, each terminal including a mating portion extending into the cavity and a tail portion projecting around the mounting face of the housing for electrically connecting to the circuit board, the mating portions of the row of the terminals being arranged in a direction generally perpendicular to the mounting face of the housing;

wherein the connector comprises an insulating body, and the terminals are secured in the insulating body to form a terminal insert, the terminal insert being inserted into the insulating housing for securing the terminals in the housing;

wherein the insulating body has a first and a second portion generally perpendicular to each other, and the second portion has a bottom face flush with the mounting face of the insulating housing;

wherein the terminals each include a retention portion interconnecting the mating portion with the tail portion, the retention portions each having a first section disposed in a common vertical plane, the tail portions of the terminals spacing varied distances from the common vertical plane of the first sections;

further comprising a shield assembled to the insulating housing for providing electromagnetic interference protection to signals transmitted through the terminals.

* * * * *